United States Patent [19]

Möhring

[11] 4,412,222

[45] Oct. 25, 1983

[54] DUAL POLARIZED FEED WITH FEED HORN

[75] Inventor: Günter Möhring, Langenhagen, Fed. Rep. of Germany

[73] Assignee: Kabel- und Metallwerke Gutehoffnungshütte Aktiengesellschaft AG, Hanover, Fed. Rep. of Germany

[21] Appl. No.: 280,712

[22] Filed: Jul. 2, 1981

[30] Foreign Application Priority Data

Jul. 19, 1980 [DE] Fed. Rep. of Germany ..... 3027497

[51] Int. Cl.[3] ..... H01Q 13/02; H01Q 19/13

[52] U.S. Cl. ..... 343/779; 343/786

[58] Field of Search ..... 343/756, 786, 840, 779

[56] References Cited

U.S. PATENT DOCUMENTS 2,364,371 12/1944 Katzin ..... 343/756

3,789,406 1/1974 Wernli ..... 343/786

*Primary Examiner*—Eli Lieberman

*Attorney, Agent, or Firm*—Martin A. Farber

[57] ABSTRACT

The present invention relates to a dual polarized feed by which two linearly polarized waves can be reliably separated. The two waves are conducted separately over high frequency coaxial cables, one of which extends axially and the other radially into the polarizer. Rotation of the planes of polarization is thus unnecessary and the two cables have a minimum influence on the illumination (irradiation) of the reflector.

14 Claims, 5 Drawing Figures

DUAL POLARIZED FEED WITH FEED HORN

The present invention relates to a dual polarized feed with feed horn for the separation of two linearly polarized electromagnetic waves for irradiation of a directional antenna with parabolic reflector, comprising a circular length of tube (herein called "tube length") which is closed by a short-circuit plate on the side thereof facing away from the reflector and on the side facing the reflector has a feed horn with an aperture which widens in the direction towards the reflector, to which tube length two feeder lines which conduct the electromagnetic waves separately are connected in such a manner that they lie in one plane one behind the other with respect to the reflector.

Directional antennas serve for the wireless transmission of electromagnetic waves from one place to another and are used in this connection, for instanace, for radio links, satellite links and radio position finding. They should have the highest possible efficiency and are therefore equipped with drivers which have a very high attenuation of the side lobes in the disturbing directions, good match and good gain for the antennas. The drivers provided with a feed horn are arranged at the focal point in the case of parabolic antennas, so that the connected feeder line, which is generally an electromagnetic waveguide, causes shadowing regions which detrimentally affect the radiation characteristics of the antenna.

This disadvantage can be even greater if the antenna is used for two electromagnetic waves which are separate from each other and which are either sent out or received simultaneously or one of which is sent and the other simultaneously received. In such antennas a dual polarized feed is provided in front of the feed horn, into which two feeder lines which conduct the two waves, separately discharge. Since the two waves must be suitably decoupled, the feeder lines are connected, 90 degrees apart from each other, to the polarization filter, resulting in increased shadowing regions on the antenna.

In the known polarizer of U.S. Pat. No. 3,864,688, which has been described above, the shadowing regions are kept small in the manner that the two feeder lines, which are formed as waveguides, are connected in the same plane to the tube length. They can thereby easily be brought in one plane one behind the other. Such a connection, to be sure, has the disadvantage that a considerable additional expense must be incurred for the separation of the two electromagnetic waves in the tube length since one wave must be turned by 90 degrees with low reflection without disturbing the other wave. In this known arrangement this is done, for example, with pins which are arranged in the tube length staggered from each other in the circumferential direction, or with a sheet metal strip which is twisted.

The object of the present invention is to provide a dual polarized feed for two electromagnetic waves which assures the slightest shadowing regions of the antenna, is of simple construction, permits simple connection of the feeder lines and does not require any additional expense for the separation of the two waves.

This object is achieved in a dual polarized feed of the above-mentioned type in accordance with the invention in the manner that the feeder lines are formed as high frequency coaxial cables (4, 5) having an inner conductor and a concentric outer conductor separated from the inner conductor by a dielectric, that one cable (5) with an inductive probe (8) at the end short-circuit plate (7) is connected in the axial direction of the tube length (6) to the latter, that the second cable (4) with a capacitive probe is connected radially to the tube length, and that a flat short-circuit plate (11) extending from wall to wall of the tube length is arranged between the points of connection of the two cables.

By the different connections of the two feeder lines to the tube length - on the one hand axially on an end side and on the other hand radially on the circumference - the feeder lines can be arranged in one plane one behind the other, without difficulty. The shadowing of the antenna by the feeder lines is thereby reduced to a minimum and the radiation properties of the antenna are correspondingly improved. Furthermore, due to the different connections, there are obtained, without any additional expense, two electromagnetic waves which are perpendicular to each other and decoupled excellently. The dual polarized feed can therefore be constructed very simply, of a few parts, and the connection of the feeder lines can also be effected very simply by ordinary means. The use of the high frequency coaxial cables (HF cables) affords the further advantage that small cross-sections can be used for the feeder lines, which would not be possible with waveguides for the same frequency range. By the inductive sensor on the one hand and the capacitive sensor on the other hand only the coaxial TEM-waves still need be converted into suitable $H_{11}$-waveguide waves. In order to be able to effect this conversion as free of reflection as possible, the two sensors are displaceable from the outside in accordance with a further concept of the invention.

Furthermore in accordance with the invention, between the short-circuit plate (11) and the connecting point of the first cable (5) there is arranged a flat absorber (12) which lies in the same plane as the short-circuit plate.

Furthermore in accordance with the invention, the outer conductor of the first cable (5) is connected to the short-circuit plate (7) and the inner conductor (15) thereof is connected, while passing through the short-circuit plate, to a cross-piece which lies within the tube length (6) and has three cylindrical bolts (13) staggered 90 degrees from each other and is conductively connected with the tube length.

Still further in accordance with the invention, the bolts (13) are displaceable in their respective axial direction.

The bolts (13) furthermore have steps or recesses (16) turned therein.

Still further in accordance with the invention, the outer conductor of the second cable (4) is connected to the tube length (6) and the inner conductor thereof is connected with a pin (9) which extends radially into the tube length.

Furthermore in accordance with the invention, the telescopically formed pin (9) is displaceable in the axial direction by a non-conductive finger (10) which extends into the tube length (6) from the opposite side thereof.

Furthermore the aperture of the feed horn (17) is widened (flared) linearly. Still furthermore the aperture of the feed horn (17) can be non-linearly widened for example exponentially (FIG. 4).

Still furthermore the aperture of the feed horn (17) can be widened stepwise (FIG. 5).

With the above and other objects and advantages in view, the present invention will become more clearly understood in connection with the detailed description of preferred embodiments, when considered with the accompanying drawings, of which:

Figure 1:
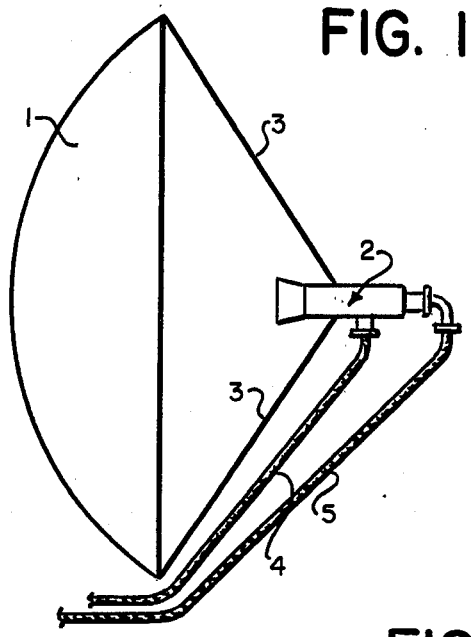
FIG. 1 is an overall elevational view of an antenna having a dual polarized feed in accordance with the invention.
Figure 2:
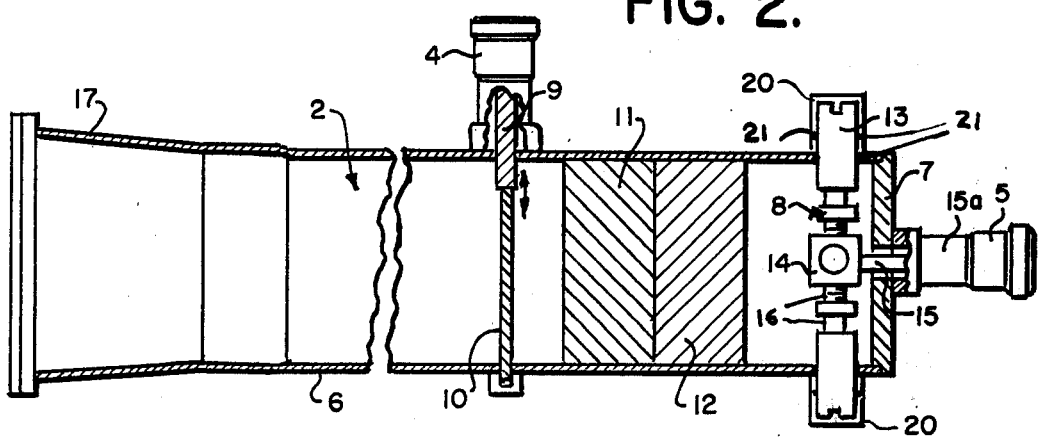
FIG. 2 shows the dual polarizer feed on a larger scale.
Figure 3:
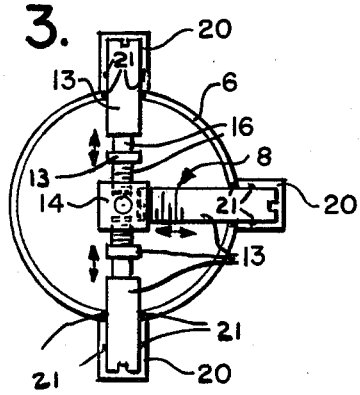
FIG. 3 is a view cross-wise to FIG. 2 showing an individual part of the dual polarizer feed.

A reflector 1 of a parabolic antenna is illustrated, at the parabolic focus of which there is arranged a dual polarizer feed 2, the construction of which can be noted in greater detail from FIGS. 2 and 3. This dual polarizer feed is fastened in position by a mechanical support such as connection rods 3 or guy wire 3 or other insulated materials. Two HF-cables 4 and 5 are connected to the dual polarized feed in such a manner that the HF-cable 4 extends radially into the dual polarized feed while the HF-cable 5 is connected axially to it.

The dual polarized feed 2 comprises a circular tube length 6 which is connected at one end thereof to a short-circuit plate 7 and at its other end has a feed horn 17, from the opening or aperture of which the linearly polarized electromagnetic waves emerge for the total irradiation of the parabolic antenna. The HF-cable 5 is connected in the axial direction of the tube length 6, the outer conductor 15*a* thereof being connected directly to the metallic short-circuit plate 7, while the inner conductor 15 extends through the short-circuit plate (spaced therefrom) and is connected to an inductive sensor 8, which in its turn is connected to the tube length 6. The HF-cable 4, in contradistinction to the HF-cable 5, is connected radially rather than axially to the tube length 6, the outer conductor again being connected directly with the tube length 6. The inner conductor of the HF-cable 4 is coupled with a capacitive sensor 9 extending into the tube length 6, the capacitive sensor being formed in the present case as a pin 9. This pin extends radially into the tube length 6 spaced therefrom and can be displaced in its axial direction. For this purpose an axially displaceable non-conductive finger 10 extends from the opposite side (wall) of the tube length into the tube length length 6, the finger being made of insulating material and resting against the inwardly protecting free end side of the pin 9.

Between the connection points of the two HF-cables 4 and 5, in the vicinity adjacent the point of connection of the HF-cable 4, there is arranged a flat short-circuit plate 11 which extends transversely over the tube length 6 and rests against the wall thereof (i.e. wall to wall). Between the short-circuit plate 11 and the point of connection of the HF-cable 5, a flat absorber 12 can also be arranged in the same plane as the short-circuit plate 11, the absorber 12 being provided to prevent any waves which may nevertheless be traveling in the wrong direction from being propagated further. The short-circuit plate 11 and the absorber 12 are thin, flat, plate-shaped members. That is they are not cylinders nor discs. They can thus lie only in one plane. The absorber 12 is arranged such that it can be regarded as an extension of the short-circuit plate 11 and correspondingly lies in the same plane as the short-circuit plate 11. The absorber 12 can contact the short-circuit plate 11 or there can even be a gap between both members 11 and 12.

The inner conductor 15 of the HF-cable 5 is insulated by a bushing from the short-circuit plate 7 and is connected to the tube length 6 via the inductive sensor 8. The inductive sensor 8 comprises, for instance, a cross piece which has three bolts 13 which are 90 degrees apart. These bolts are fastened into a central piece 14, for instance, threaded into it, the inner conductor 15 of the HF-cable 5 being also connected to this piece 14. The three bolts 13 are in each case connected in an electrically conductive manner with the tube length 6 and can be displaced from the outside via end-side slots, for instance, by the use of an insulated screw-driver, so that a coupling of the HF-cable 5 which is as free as possible of reflection can be established, even subsequently, after assembly, by adjustment.

In order for further possibilities for fine adjustment to exist here, the bolts 13 can have lathed or turned-in recess portions 16 which are also displaced in corresponding manner upon the axial displacement of the bolts 13. As shown in FIG. 3 diametrically opposite bolts 13 can be formed with steps 16 (grooves turned therein) and a third bolt 13 perpendicularly thereto can be formed cylindrically.

That is, the parts 13 and 16 are made of one-piece and are part of the inductive sensor 8. This sensor 8 is made of three parts 13, two of which, corresponding to FIG. 3, have the grooves 16 turned therein, and of the central part 14 into which the bolts 13 are adjustably screwed. The central part 14 is held in its position by the cylindrical horizontal part 13 in FIG. 3 (not visible in FIG. 2) on the one hand as well as by the inner conductor 15 on the other hand. The electrically conductive connection of the inductive sensor 8 with the tube piece 6, for example, can be done by soldering. The bolts 13 are in this manner mechanically and electrically conductingly connected with the covering caps 20, whereby the electrically conducting path is closed. The soldering is indicated schematically by reference numerals 21, which is performed after the screwing adjustment of the bolts 13 in the part 14.

As already mentioned, the inner conductor of the HF-cable 4 can be connected to the pin 9 which is displaceable in its axial direction. This pin 9 can be formed, for example, telescopically so that it can be displaced in its axial direction subsequently from the outside by the finger 10 made of insulating material.

Figure 4:
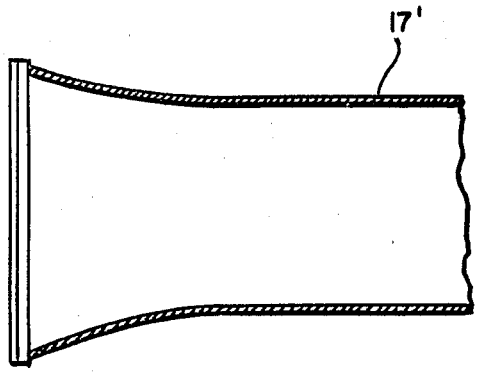
FIGS. 4 and 5 are broken away cross-sectional views showing two different embodiments of widening of the aperture of the feed horn.
Figure 5:
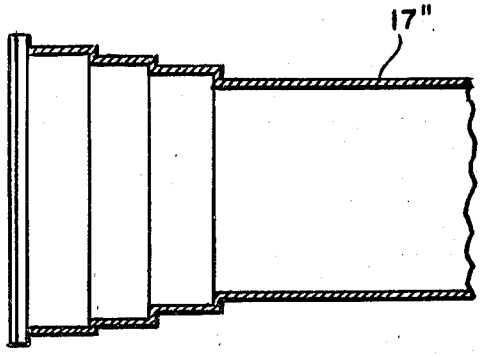

The feed horn 17 has an aperture which widens flaring in the direction towards the reflector of the parabolic antenna. This widening may be conical and therefore linear, but it may also be non-linear in the form of a curve such as an exponential curve (FIG. 4) and it is also possible to form this widening in step shape (FIG. 5).

While embodiments of the invention have been described, it is to be understood that these embodiments are given by example only and not in a limiting sense.

I claim:

1. In a dual polarized feed having a feed horn for the separation of two linearly polarized electromagnetic waves for the irradiation of a directional antenna with a parabolic reflector, and comprising a circular tube length which is closed by a short-circuit plate on the side thereof facing away from the reflector and on the side facing the reflector has the feed horn with an aperture which widens in the direction towards the reflector, and two feeder lines which conduct the electromagnetic waves are separately connected to the tube length in such a manner that they lie in one plane one behind the other with respect to the reflector, the improvement wherein each of the feeder nes being formed as a high frequency coaxial cable comprising an inner conductor and a concentric outer conductor and a dielectric separating said outer conductor from the inner conductor, an inductive sensor being disposed at the short-circuit plate, the latter being disposed at an end side of the tube length, one of said coaxial cables is connected to said inductive sensor, said one coaxial cable at a connection place is operatively connected in the axial direction of the tube length to the latter, a capacitive sensor being connected to the other of said coaxial cables, said other coaxial cable is operatively connected radially to the tube length at another connection place, a flat short-circuit plate extending from wall to wall of the tube length is arranged between the said connection places of said two coaxial cables.

2. The dual polarized feed as set forth in claim 1, further comprising a flat absorber is disposed at a same plane as said flat short-circuit plate between said flat short-circuit plate and said connecting place of said one coaxial cable.

3. The dual polarized feed as set forth in claim 2, wherein said flat absorber engages one side of said flat short-circuit plate.

4. The dual polarized feed according to claim 1 or 2, wherein said outer conductor of said one coaxial cable is connected to said first-mentioned short-circuit plate and said inner conductor of said one coaxial cable extends through said first-mentioned short-circuit plate spaced therefrom, said inductive sensor comprises a cross-piece disposed within the tube length and three cylindrical bolts staggered 90 degrees from each other conductively connected with said tube length, said inner conductor of said one coaxial cable is connected to said cross-piece.

5. The dual polarized feed according to claim 4, wherein said bolts are conductively connected with said tube length and are displaceable in their respective axial directions.

6. The dual polarized feed according to claim 5, wherein said bolts radially extend into said tube length.

7. The dual polarized feed according to claim 4, wherein the bolts are formed with steps turned therein.

8. The dual polarized feed according to claim 1, wherein said outer conductor of said other coaxial cable is connected to said tube length, a pin extends radially into said tube length spaced therefrom and constitutes said capacitive sensor, said inner conductor of said other coaxial cable is connected to said pin.

9. The dual polarized feed according to claim 8, further comprising means for displacing said pin in an axial direction of the latter.

10. The dual polarized feed according to claim 9, wherein said means comprises a non-conductive finger displaceably extending into said tube length from opposite to said pin and engaging a free end of said pin, said pin is a telescopic pin.

11. The dual polarized feed according to claim 1, wherein the aperture of said feed horn is widened linearly.

12. The dual polarized feed according to claim 1, wherein the aperture of said feed horn is widened non-linearly.

13. The dual polarized feed according to claim 1, wherein the aperture of said feed horn is widened step-wise.

14. The dual polarized feed according to claim 1, wherein said inner conductor of said one coaxial cable extends through said first-mentioned short-circuit plate spaced therefrom, said capacitive sensor extends through said tube length spaced therefrom.

* * * * *

UNITED STATES PATENT AND TRADEMARK OFFICE

CERTIFICATE OF CORRECTION

PATENT NO. : 4,412,222

DATED : October 25, 1983

INVENTOR(S) : Günter Mühring

It is certified that error appears in the above-identified patent and that said Letters Patent are hereby corrected as shown below:

Claim 1, (Line 5, Column 5) "nes" should read --lines--

Signed and Sealed this

Twentieth Day of March 1984

[SEAL]

Attest:

GERALD J. MOSSINGHOFF

Attesting Officer

Commissioner of Patents and Trademarks